US005284340A

United States Patent [19]

Laakso

[11] Patent Number: 5,284,340

[45] Date of Patent: Feb. 8, 1994

[54] GOLF SCORECARD

[76] Inventor: John K. Laakso, 3456 Fairview Ct., Kennesaw, Ga. 30144

[21] Appl. No.: 952,669

[22] Filed: Sep. 28, 1992

[51] Int. Cl.[5] ..... A63B 57/00

[52] U.S. Cl. ..... 273/32 H; 283/50

[58] Field of Search ..... 273/32 H, 32 R, 32 B; 283/48.1, 49, 52, 52.1, 50; 281/2, 5, 15.1

[56] References Cited

U.S. PATENT DOCUMENTS

| | | | |
|---|---|---|---|
| 440,783 | 11/1890 | Wells | 283/52.1 |
| 1,353,889 | 9/1920 | Brown . | |
| 1,514,254 | 11/1924 | Macdonald | 283/50 |
| 2,169,536 | 8/1939 | Morris | 283/49 |
| 3,820,786 | 6/1974 | Candor | 273/32 H |
| 3,883,161 | 5/1975 | McGee et al. . | |
| 3,965,595 | 6/1976 | Kjellquist | 273/32 H X |
| 4,331,425 | 5/1982 | Davis, Jr. . | |
| 4,505,478 | 3/1985 | Riethmiller | 273/32 H |
| 4,666,156 | 5/1987 | Wakisaka | 273/32 H |
| 4,666,157 | 5/1987 | Bodine et al. . | |
| 4,783,071 | 11/1988 | Tattershall | 273/32 H |
| 4,814,216 | 3/1989 | Brunett et al. | 281/2 X |
| 5,013,069 | 5/1991 | Hardin . | |
| 5,013,070 | 5/1991 | Maude, Sr. . | |
| 5,094,451 | 3/1992 | Glamack . | |

FOREIGN PATENT DOCUMENTS

| | | | |
|---|---|---|---|
| 6224 | 1/1977 | Japan | 283/49 |
| 1371076 | 10/1974 | United Kingdom | 283/49 |

*Primary Examiner*—William Stoll

*Attorney, Agent, or Firm*—Brooks & Kushman

[57] ABSTRACT

A golf scorecard and playing booklet is disclosed. The booklet has at least ten sheets which are folded together accordion style. A front cover is provided so that when the sheets are folded they form a booklet listing the name and identity of the golf course. A scorecard for keeping score is provided on the second sheet. Eighteen additional sides of the remaining sheets contain a depiction and description of the holes of the golf course and tips on how to play the hole. An additional sheet can be provided for advertising and promotional purposes.

10 Claims, 5 Drawing Sheets

10

10'

GOLF SCORECARD

TECHNICAL FIELD

The present invention relates to golf scorecards and yardage guide booklets which assist golfers in playing the various holes of a golf course and keeping score. After playing, the booklet comprises an attractive souvenir of the golf course that the players will want to keep for future reference.

BACKGROUND OF THE INVENTION

The present invention relates to the game of golf and a device for playing a particular course and keeping score. Golf has proven to be a challenging sport and has become increasingly popular today. It is one of the fastest growing sports today. New golf courses and resorts are being built across the United States on a regular basis, increasing tourism and attracting golfers. Many of the golf courses are being designed by famous golf course designers and players and the lure of playing a course designed by that individual or because of its geography, scenic nature or the difficulty of the playing conditions and course, the demand for playing the new courses is increasing at a rapid rate.

Virtually every golf course has a scorecard of some type which is provided to the players. The scorecards are used to keep the score of the individual golfers on a hole by hole basis, while some others show the layout of the golf course and various holes, and still others accomplish both functions. These scorecards come in various sizes and shapes and have significantly different formats. Some courses also provide (some for an additional charge) a hole by hole layout of the golf course showing the location of various traps, water and other hazards and often giving the distances from various points on the holes to the green or pin.

Most of these golf scorecards do not provide the golfer with sufficient information for playing the course. Also, some of the scorecards are difficult to use due to their size or format. In addition, some of the scorecards cannot easily fit within a player's pocket without being folded which destroys the integrity of the card. Moreover, most of the golf scorecards are not of the type that the player will want to use for future reference or keep as a souvenir or memento.

Accordingly, it is an object of the present invention to provide a combined golf scorecard and yardage guide which is an improvement over known golf scorecards and playing booklets. It is another object to provide a compact and convenient golf scorecard and yardage guide which contains more information than most golf scorecards and in a more readily usable form.

It is a further object of the invention to provide a golf scorecard and playing booklet that a player will want to keep as a souvenir and for future reference. It is a still further object of the invention to provide a golf scorecard and playing booklet of a form and type that can be utilized at a large number of golf courses so that the player can keep and maintain a group of similar playing scorecards from different courses.

Another object of the present invention comprises providing a golf scorecard and playing booklet which has space for advertising and promotion so that it alternately can be used as a business promotion or giveaway item. Another feature of the invention is to provide a golf scorecard and playing booklet that has a series of sheets of card material connected together accordion style which allows for a reproduction of the individual holes with sufficient size and clarity for ease of access and also allows opening, closing and inspection in an easy and convenient manner.

SUMMARY OF THE INVENTION

The present invention comprises a golf scorecard and playing booklet combined in a unitary structure. The device is uniquely configured to provide a player with information and guidance for playing each of the holes of a golf course as well as keeping score in a convenient manner. The golf scorecard and playing booklet comprises at least ten separate sheets connected along one edge and folded accordion style to form (when folded) a compact and usable package. The ten individual sheets of the booklet comprise twenty sides for information and preferably include eighteen sides displaying the individual holes of the golf course, one scorecard side, and a front cover side.

An alternate embodiment of the invention contains eleven sheets in a booklet. Ten sheets are similar to the first embodiment while the eleventh sheet is to be used for listing local rules and notes of interest relative to the particular golf course on one side, and an additional side for advertising and promotional purposes.

A holder for a scoring pencil or pen can also be provided on the booklet, if desired. The holder comprises a series of small slits or openings on one card which facilitates easy placement and use of the scoring device.

Others objects, features and advantages of the present invention will become readily apparent from the following description, accompanying drawings, and appended claims.

BEST MODE(S) FOR CARRYING OUT THE INVENTION

Figure 1:
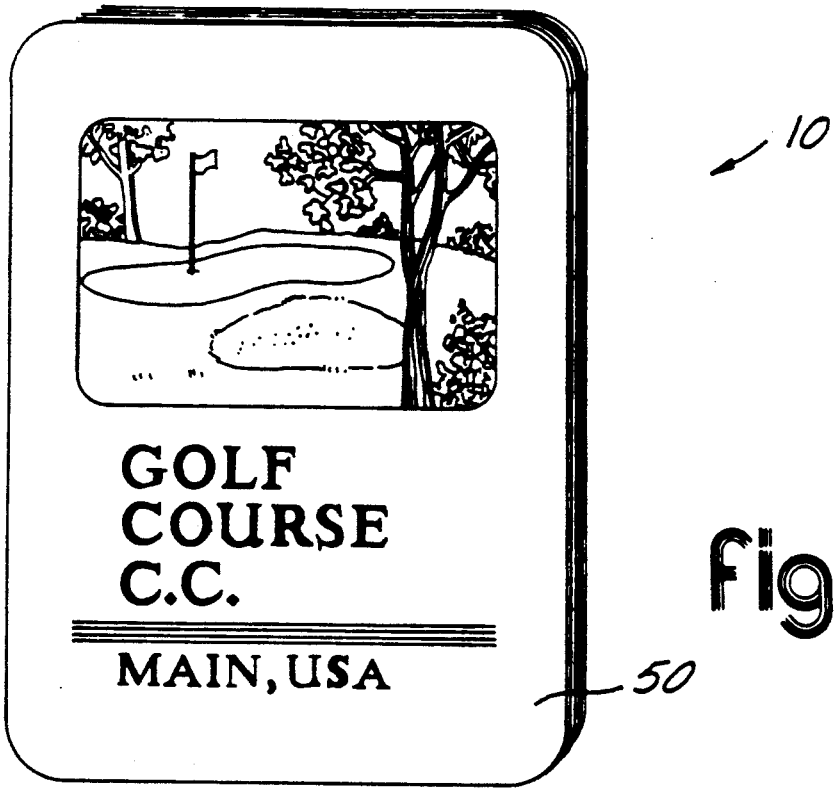
FIG. 1 illustrates the preferred golf scorecard and playing booklet in accordance with the present invention.
Figure 2:
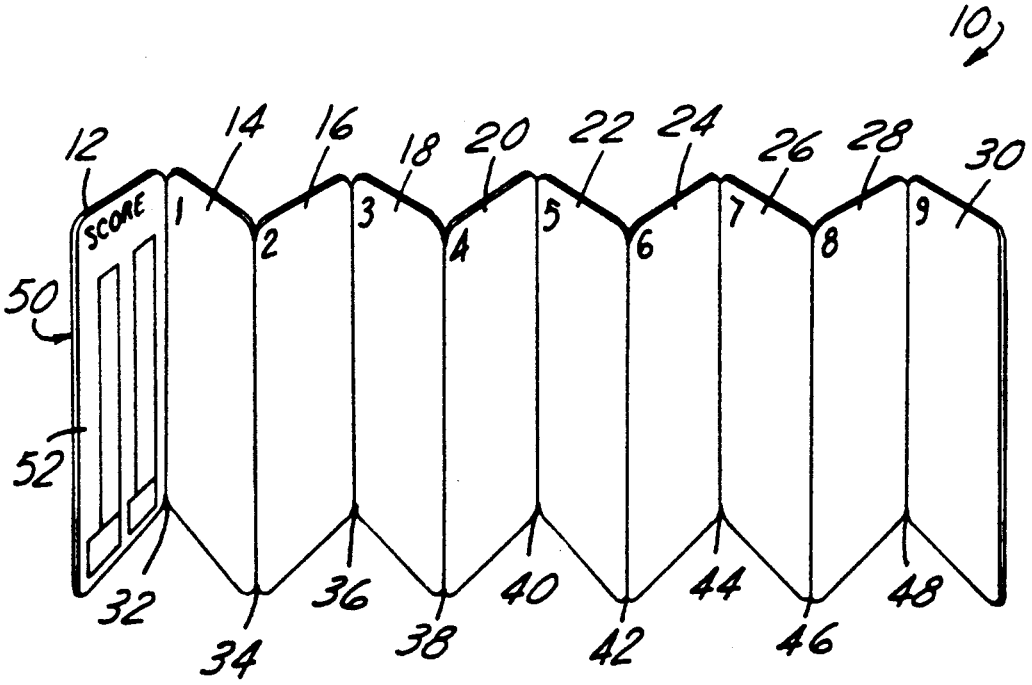
FIGS. 2 and 3 illustrate one side of the golf scorecard and playing booklet in accordance with the present invention.
Figure 3:
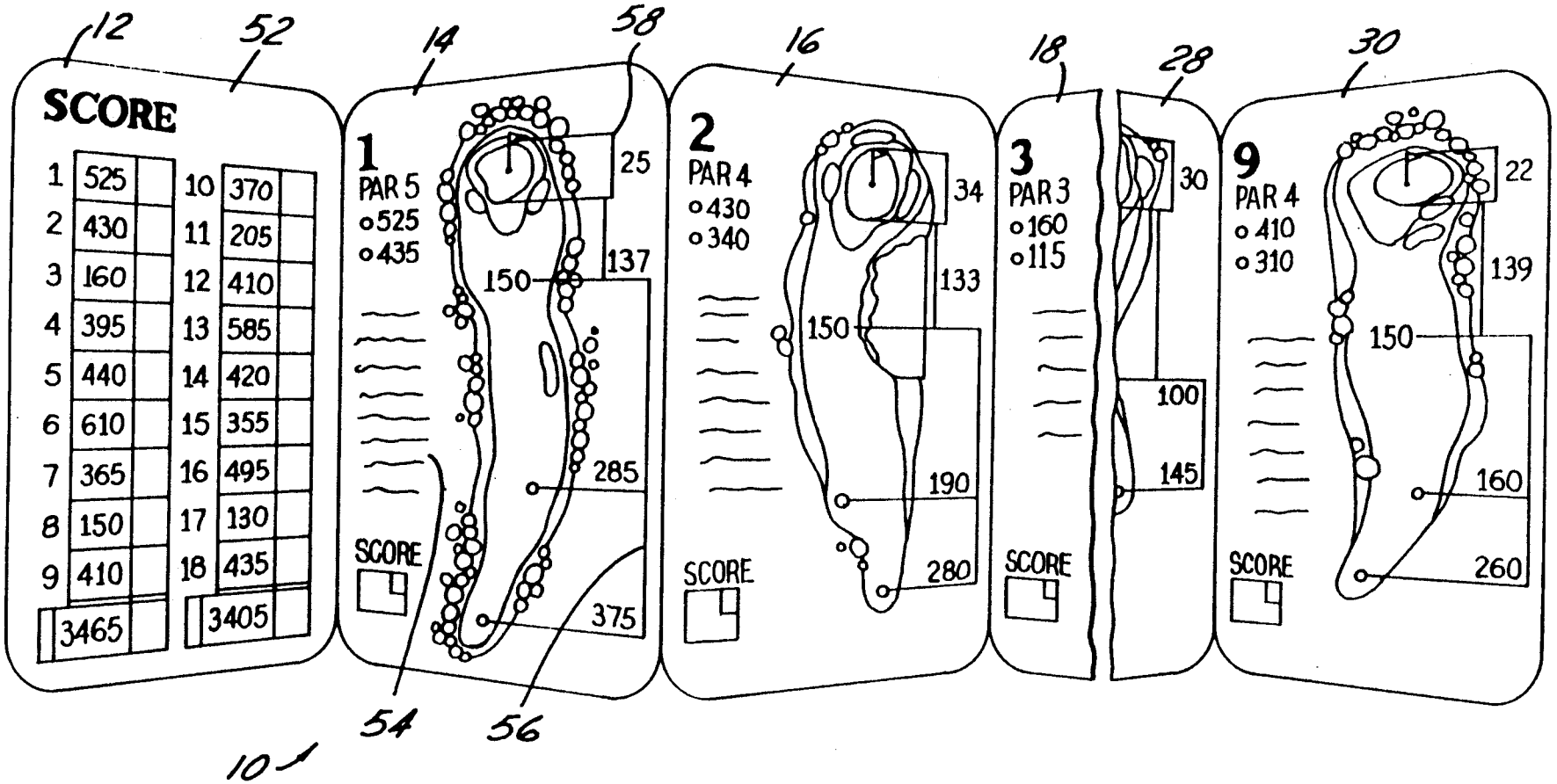
Figure 4:
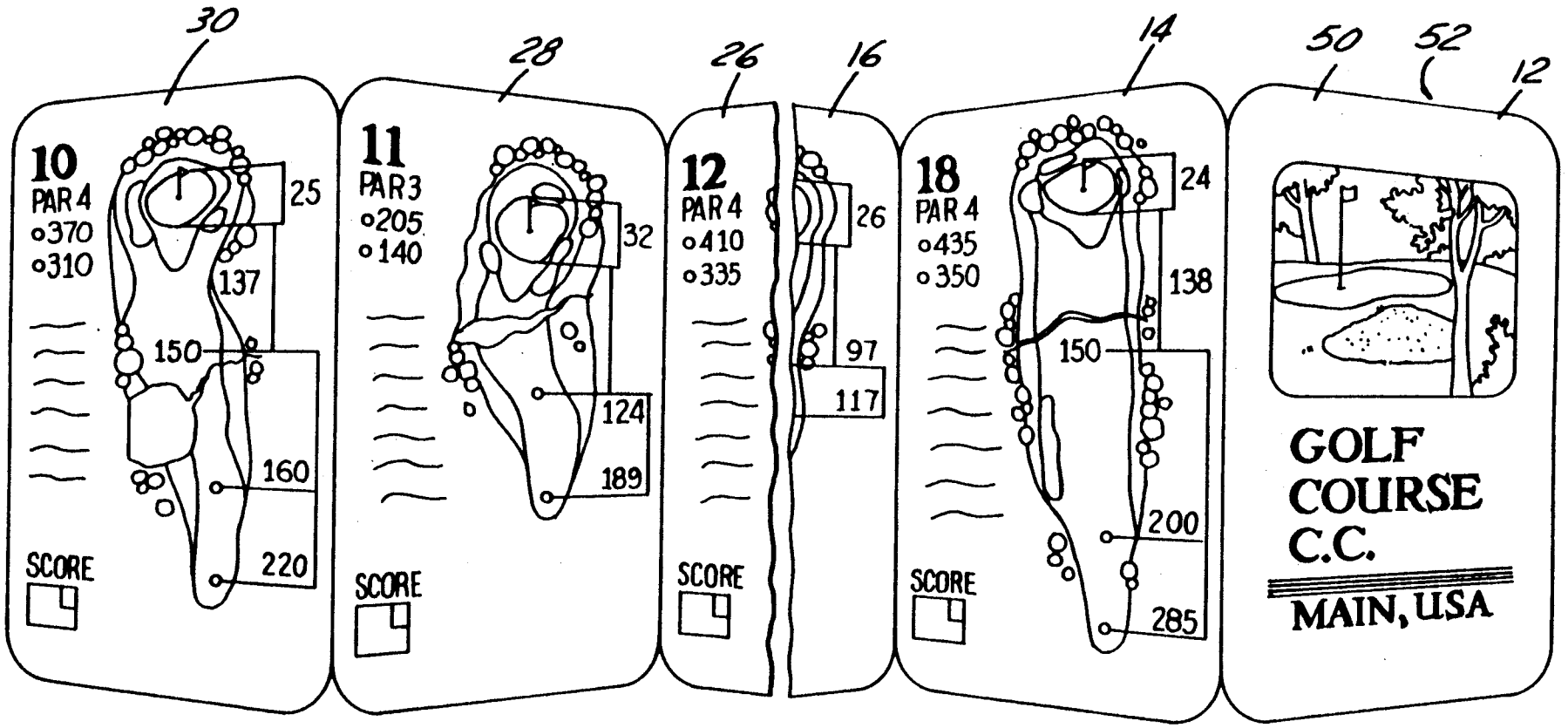
FIG. 4 illustrates the side of the invention opposite to that shown in FIGS. 2 and 3.

FIGS. 1–4 illustrate one embodiment of the present inventive golf scorecard and playing booklet 10. The invention in its folded compact form is shown in FIG. 1 while FIGS. 2–4 show the two opposite sides of the invention when it is in its expanded form.

The golf scorecard and playing booklet comprises an accordion-style booklet preferably having ten separate but connected sheets. For reference purposes, the individual sheets are numbered 12, 14, 16, 18, 20, 22, 24, 26, 28 and 30. One side of the sheets 12–30 are shown in FIGS. 2 and 3 and the opposite sides are shown in FIG. 4.

The booklet comprises a single piece of hard paper or card stock cut or trimmed in the manner shown in FIG. 1 and folded together along fold lines 32, 34, 36, 38, 40, 42, 44, 46, and 48. The booklet 10 can be expanded to comprise a single flat sheet or folded to form a booklet in the form shown in FIG. 1.

The front cover 50 of the booklet preferably contains the name of the course and its address, along with a drawing or photograph illustrating some feature associated with it. When the booklet 10 is folded as shown in FIG. 1, the booklet provides an attractive memento of the course in order for the player to keep for future reference and as a souvenir.

The first inside card or sheet side 52 of the booklet 10 preferably comprises an actual scorecard for the player to keep his score. If desired, the side 52 could also be configured to record the scores of the other players playing in the group with him, although this is not the primary purpose of the invention. The format for sheet side 52 can be of any conventional type in which the scores can be recorded on a hole by hole basis on a grid with a nine hole total and an eighteen hole total. In addition, the yardage for each of the holes and the hole handicap ratings can also be included. Thus, sheet 12 of the booklet 10 comprises cover 50 on one side and a scorecard 52 on the opposite side.

Cards or sheets 14–30 illustrate individual golfing holes 1–9 on one side (FIGS. 2 and 3) and individual golfing holes 10–18 on the opposite side (FIG. 4). As shown in the drawings, the sides of each of these individual sheets contains one of the individual holes of the golf course and depicts it graphically and descriptively. The information relative to each hole contains the number of the hole (that is 1 to 18), the par for the hole (either 3, 4 or 5), the applicable yardage from each of the tees on the hole to the green or pin, and a written description 54 of the hole or a key point for the golfers to take into account while playing it. The latter description could be tips such as "aim tee-shot to the right middle", "beware out of bounds on the left", "aim approach at right side of green", or "water comes into play on second shot".

In addition, the descriptions for each hole on the sheets contain various yardage indications from the tee boxes to the 150-yard marker in the fairway and/or to various hazards or pins 56. In addition, the depth (length) of the greens is shown in yards by one set of brackets 58 adjacent the depiction of the green on the sheets. The layouts or depictions of the golf holes also show the various foliage or hazards which might come into play on the hole, such as sand traps, ponds, streams, trees, ravines, grass bunkers, and the like.

One important aspect of the present invention is that the golf scorecard and playing booklet 10 is of a size to conveniently fit within a player's shirt or pants pocket without having to fold it. Preferably, the booklet 10 is within the dimension of two to four inches along each edge (32–48), and preferably has an overall size of 2½ by 3½ inches. At this size, it is not necessary to fold the booklet 10 as shown in FIG. 1 in order to fit within a normal size shirt pocket or pants' pocket.

Preferably, the booklet 10 is also provided on a sufficiently hard paper or card stock which provides a firm surface for writing and handling. In this manner, the card will not become dog-eared or suffer adversely from wear and tear during the round of golf. Also, while playing the golfer can mark and record his score in a convenient manner on the scoresheet 52 without having to use an additional hard-backing surface. If desired, the player can also indicate on each of the individual hole sheets (14–30) the spots where he hit his golf ball and perhaps the club that he used and the number of putts that he needed to complete the hole.

As indicated, the booklet is formed from a single piece of paper or card stock which is folded together accordion style. The fold lines 32–40 are positioned on two sides of each of the sheets 14–28 and on one side of the sheets 12 and 30 such that the sheets are folded face-to-face to form the booklet 10. Due to the manner in which the booklet is made and folded, it is also possible for the golfer to fold the card back upon itself to display specific one or two holes at a time if desired. Moreover, when the booklet is used, the scoresheet 52 is always within easy access for recording of the scores.

The location of the scoresheet 52 on the sheets of the booklet 10 does not have to be in the location shown in FIGS. 2 and 3. For example, the scorecard can be on the sheet 30 (as shown in FIGS. 2 and 3) with the individual hole descriptions starting on sheet 12 and extending through sheet 28 for holes 1–9. It also would be possible to have the scorecard 52 positioned on the reverse side of sheet 30 as shown in FIGS. 2 and 3.

It is preferable, however, that holes 1–9 be depicted as a group on one side of the booklet sheets and holes 10–18 be positioned as a group on the opposite side. This makes the booklet more convenient for use by the player.

Figure 5:
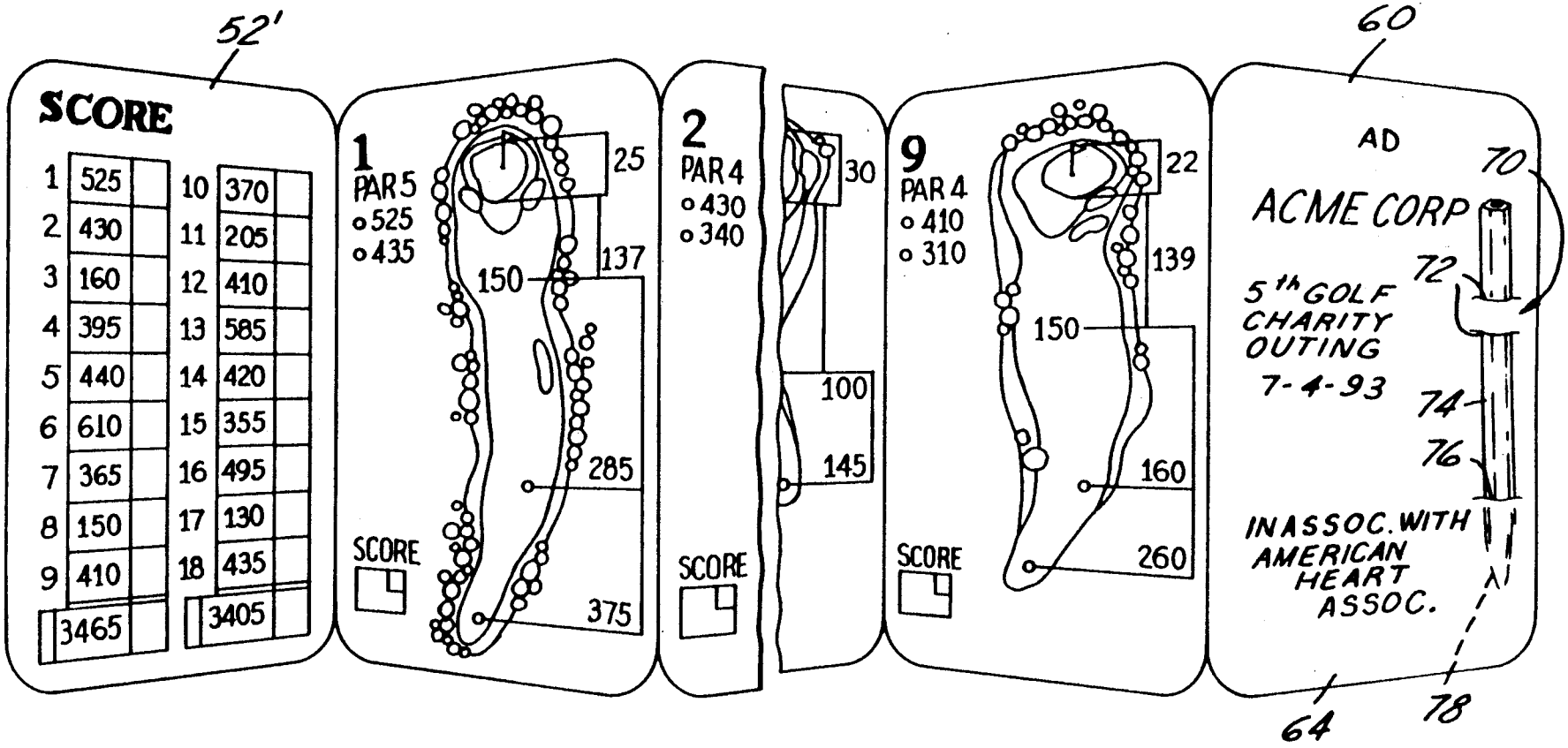
FIG. 5 illustrates one side of an alternate embodiment of the invention.
Figure 6:
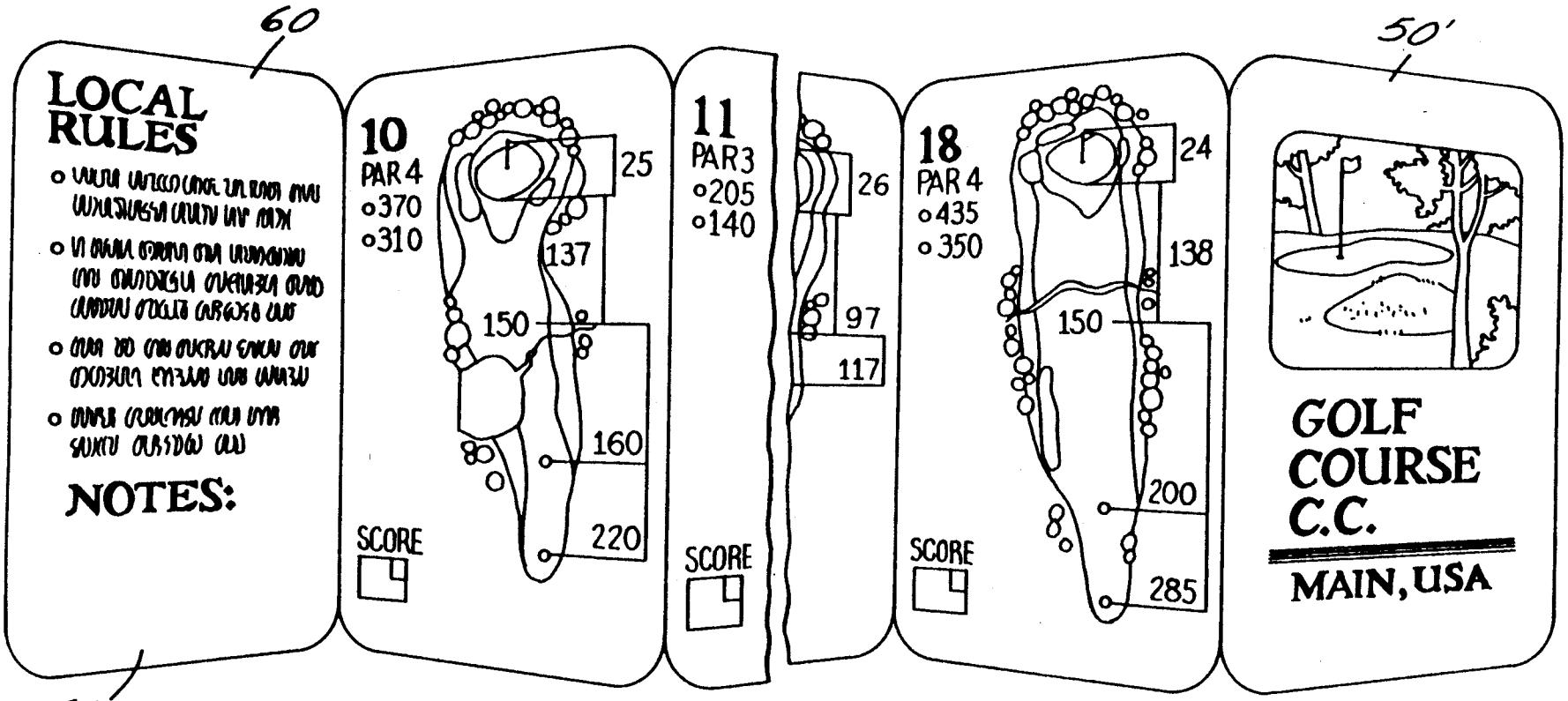
FIG. 6 illustrates the opposite side of the invention shown in FIG. 5.

FIGS. 5 and 6 illustrate an alternate embodiment of the invention. In this embodiment, an eleventh sheet 60 is included in the booklet 10'. The booklet 10' has a front cover sheet 50' which is similar to sheet 50 in the embodiment shown in FIGS. 1–4. In addition, the booklet has a scorecard 52' which is similar to the scorecard 52 described above and can be positioned in similar locations.

In the alternate embodiment, the additional sheet 60 provides two additional sides or spaces for additional information. In particular, the embodiment 10' has one sheet side 62 which can contain additional information relative to the course, such as local rules or notes which may be of interest to the player and dictate the manner in which the course should be played. For example, the local rules could dictate the use and positioning of carts on the various holes, remind the golfers about repairing ball marks on the greens and replacing divots, and specify the number of clubs per bag per player, and the like.

In addition, the additional sheet 60 provides additional space on one side 64 which can be used for advertising and promotion. For example, for golf outings or for companies which would like to provide scorecards and playing booklets for promotional and advertising purposes, the company or business concern could include a sheet of information relative to the business or its services or products that it provides. The sheet 64 could also provide information relative to a particular outing or event with which the booklet 10' is being used, such as for a charitable or company outing.

A pencil or pen holder 70 can also be provided on the booklet 10' in order to store a marker for quick and convenient use. (It is also understood that a pencil holder 70 could be provided on the booklet 10 in the embodiment shown in FIGS. 1–4.) The holder 70 includes a pair of parallel slits or openings 72 for holding the pencil 74 adjacent one end and another slit or opening 76 in which the pointed writing end 78 of the end of the pencil is "hidden" inside the booklet preventing snagging or damage to the player's pocket or clothing.

Preferably, a number of courses of a particular designer or particular organization (such as the "TPC"

golf courses), or from a certain geographical area in the country (such as Myrtle Beach, Hilton Head, and the like), could provide scorecards and playing booklets 10 all of a similar size, coloration and typeface. This would allow the players to collect the booklets as mementos and souvenirs which can be used in the future to refer back to the rounds of golf that were played and the details of the golf courses. The booklet would contain the scores that the golfers shot on that particular day and depict each of the holes that were played so that they can remember and visualize the courses and their performances.

It is understood that the present invention is not limited for use with golf courses only containing 18 holes of golf. The invention is equally applicable to golf courses with 27, 36 or more golf holes. In order to provide the same information for these courses, a scorecard/yardage guide having 30, 32 or more sheets folded together accordion-style could be provided.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A golf scorecard and yardage guide for assisting players in playing a golf course and keeping score, said guide comprising at least ten sheets of card material, each of said sheets having two sides, the first of said sheets being connected to another of said sheets along one edge thereof, the last of said sheets being connected to another of said sheets along one edge thereof, the remaining sheets being connected to two adjacent sheets along two opposite edges, said sheets of material being foldable along said edges into a booklet substantially the size as said first of said sheets, one side of said first of said sheets being a cover means containing information about the golf course, one side of another of said sheets being a scoresheet with a scoring grid thereon, and at least eighteen of the remaining sides of said sheets containing respective written and graphic depictions about individual holes of the golf course.

2. The golf scorecard and yardage guide as set forth in claim 1 wherein said cover means and said scoresheet are on opposite sides of the same sheet of material.

3. The golf scorecard and yardage guide as set forth in claim 1 wherein said sheets of material are of sufficient strength to be markable with a pencil or pen.

4. The golf scorecard and yardage guide as set forth in claim 1 wherein the depictions about the individual holes contained on said eighteen sides comprises a graphic depiction of the general layout of a golf hole of the golf course, sand traps, and other hazards where applicable, and yardage figures particular to such golf hole.

5. The golf scorecard and yardage guide as set forth in claim 1 wherein said guide is within the range from 3 to 4 inches in dimension per edge.

6. The golf scorecard and yardage guide as set forth in claim 1 wherein the external dimensions of said guide are sized to fit within a conventional pocket in an article of clothing.

7. The golf scorecard and yardage guide as set forth in claim 1 wherein said guide has ten sheets of material, and includes on the resultant twenty sides, a cover means, a scorecard grid, and depiction of eighteen golf holes.

8. The golf scorecard and yardage guide as set forth in claim 1 wherein said guide has eleven sheets of material.

9. The golf scorecard and yardage guide as set forth in claim 8 wherein said eleven sheets of material includes on the resultant twenty-two sides, a cover means, a scorecard grid, depictions of eighteen golf holes, a local rules statement and a promotional item.

10. The golf scorecard and yardage guide as set forth in claim 8 wherein said eleven sheets of material includes on the resultant twenty-two sides, at least the depiction of eighteen golf holes on eighteen of said sides.

* * * * *

UNITED STATES PATENT AND TRADEMARK OFFICE

CERTIFICATE OF CORRECTION

PATENT NO. : 5,284,340

DATED : February 8, 1994

INVENTOR(S) : John K. Laakso

It is certified that error appears in the above-indentified patent and that said Letters Patent is hereby corrected as shown below:

Column 4, line 64; after "end 78 of the" insert --pencil 74 is positioned. In this manner, the pointed--.

Signed and Sealed this

Twenty-first Day of June, 1994

Bruce Lehman

*Attest:*

BRUCE LEHMAN

*Attesting Officer*

*Commissioner of Patents and Trademarks*